US010305220B1

(12) United States Patent
Peacock et al.

(10) Patent No.: US 10,305,220 B1
(45) Date of Patent: May 28, 2019

(54) ELECTRICAL SOCKET SHIM ASSEMBLY

(71) Applicants: Michael Peacock, Springfield, IL (US); Cari Smith, Springfield, IL (US)

(72) Inventors: Michael Peacock, Springfield, IL (US); Cari Smith, Springfield, IL (US)

( * ) Notice: Subject to any disclaimer, the term of this patent is extended or adjusted under 35 U.S.C. 154(b) by 0 days.

(21) Appl. No.: 15/925,240

(22) Filed: Mar. 19, 2018

(51) Int. Cl.

| | |
|---|---|
| ***H01R 13/62*** | (2006.01) |
| ***H01R 24/76*** | (2011.01) |
| ***H01R 43/20*** | (2006.01) |
| ***H01R 43/26*** | (2006.01) |

(52) U.S. Cl.
CPC ..... *H01R 13/62* (2013.01); *H01R 43/20* (2013.01); *H01R 24/76* (2013.01); *H01R 43/26* (2013.01)

(58) Field of Classification Search
CPC ..... H02G 3/18; H01R 13/639; H01R 13/62; H01R 43/20; H01R 43/26; H01R 24/76; B60G 2204/4402
See application file for complete search history.

(56) References Cited

U.S. PATENT DOCUMENTS 2,772,596 A * 12/1956 Trussell ..... B62D 17/00 188/196 M
4,293,173 A * 10/1981 Tricca ..... H01R 13/443 174/67
4,948,317 A * 8/1990 Marinaro ..... F16B 43/00 220/3.7
5,477,010 A * 12/1995 Buckshaw ..... H02G 3/14 174/67
5,640,813 A * 6/1997 Glazik ..... E06B 1/6069 248/188.2
D423,909 S 5/2000 Hartin
6,275,129 B1 * 8/2001 van Oort ..... G01R 33/3873 324/320
6,368,134 B2 4/2002 Richter
6,560,934 B1 * 5/2003 Workman ..... E06B 1/6069 248/188.2
7,378,592 B2 5/2008 Suzuki
7,589,279 B2 9/2009 Haynes
7,716,880 B1 * 5/2010 Shray ..... B29C 44/583 248/188.2
9,065,203 B2 1/2015 Davies
9,088,081 B2 * 7/2015 Hildebrandt ..... H01R 13/00
9,448,295 B2 * 9/2016 Biber ..... A61B 5/055
2008/0318463 A1 12/2008 Chen
(Continued)

*Primary Examiner* — Briggitte R. Hammond

(57) ABSTRACT

An electrical socket shim assembly for inhibiting an electrical plug from freely moving in an electrical socket includes a plurality of shims and each of the shims has a first lateral side and a second lateral side. Moreover, each of the shims is concavely arcuate between the first lateral side and the second lateral side thereby facilitating each of the shims to be positioned between a corresponding circular electrical plug and a corresponding circular electrical socket. Each of the shims has a unique thickness with respect to each other for occupying a unique amount of space in the corresponding circular electrical socket. A plurality of tabs is provided and each of the tabs is coupled to a respective one of the shims. Each of the tabs is secured to a support when the respective shim is positioned between the corresponding circular electrical plug in the corresponding circular electrical socket. In this way the respective shim is inhibited from being removed from the corresponding electrical socket.

5 Claims, 4 Drawing Sheets

(56) References Cited

U.S. PATENT DOCUMENTS

| | | | | |
|---|---|---|---|---|
| 2012/0090876 | A1* | 4/2012 | Dower | H02G 15/113<br>174/174 |
| 2013/0040495 | A1* | 2/2013 | Moss | H01R 13/447<br>439/625 |
| 2013/0055610 | A1* | 3/2013 | Watkins | F41A 11/04<br>42/16 |
| 2018/0216343 | A1* | 8/2018 | Ollila | E04B 2/7433 |

* cited by examiner

ELECTRICAL SOCKET SHIM ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shim assemblies and more particularly pertains to a new shim assembly for inhibiting an electrical plug from freely moving in an electrical socket.

BRIEF SUMMARY OF THE INVENTION

An embodiment of the disclosure meets the needs presented above by generally comprising a plurality of shims and each of the shims has a first lateral side and a second lateral side. Moreover, each of the shims is concavely arcuate between the first lateral side and the second lateral side thereby facilitating each of the shims to be positioned between a corresponding circular electrical plug and a corresponding circular electrical socket. Each of the shims has a unique thickness with respect to each other for occupying a unique amount of space in the corresponding circular electrical socket. A plurality of tabs is provided and each of the tabs is coupled to a respective one of the shims. Each of the tabs is secured to a support when the respective shim is positioned between the corresponding circular electrical plug in the corresponding circular electrical socket. In this way the respective shim is inhibited from being removed from the corresponding electrical socket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
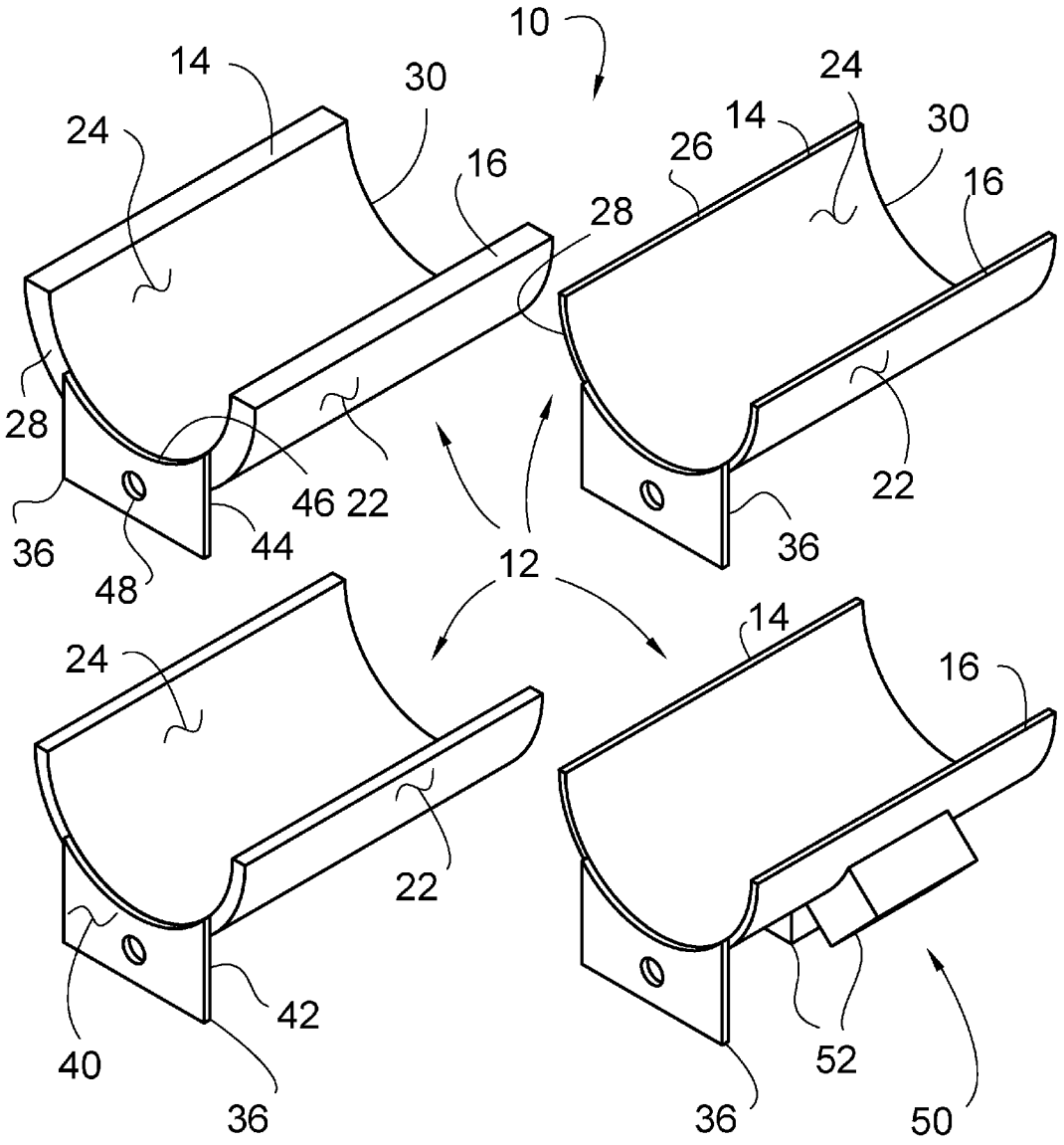
FIG. 1 is a perspective view of an electrical socket shim assembly according to an embodiment of the disclosure.
Figure 2:
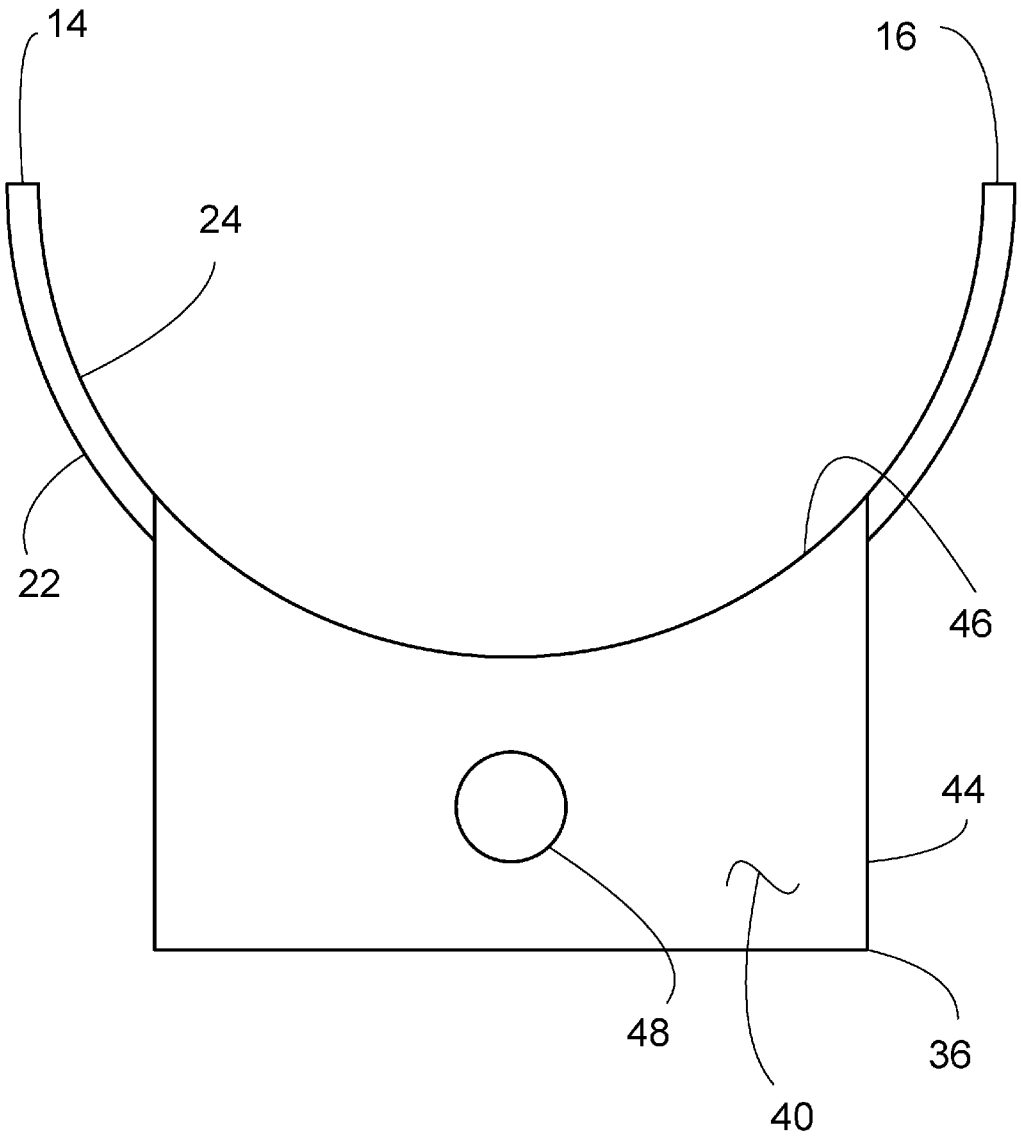
FIG. 2 is a front view of an embodiment of the disclosure.
Figure 3:
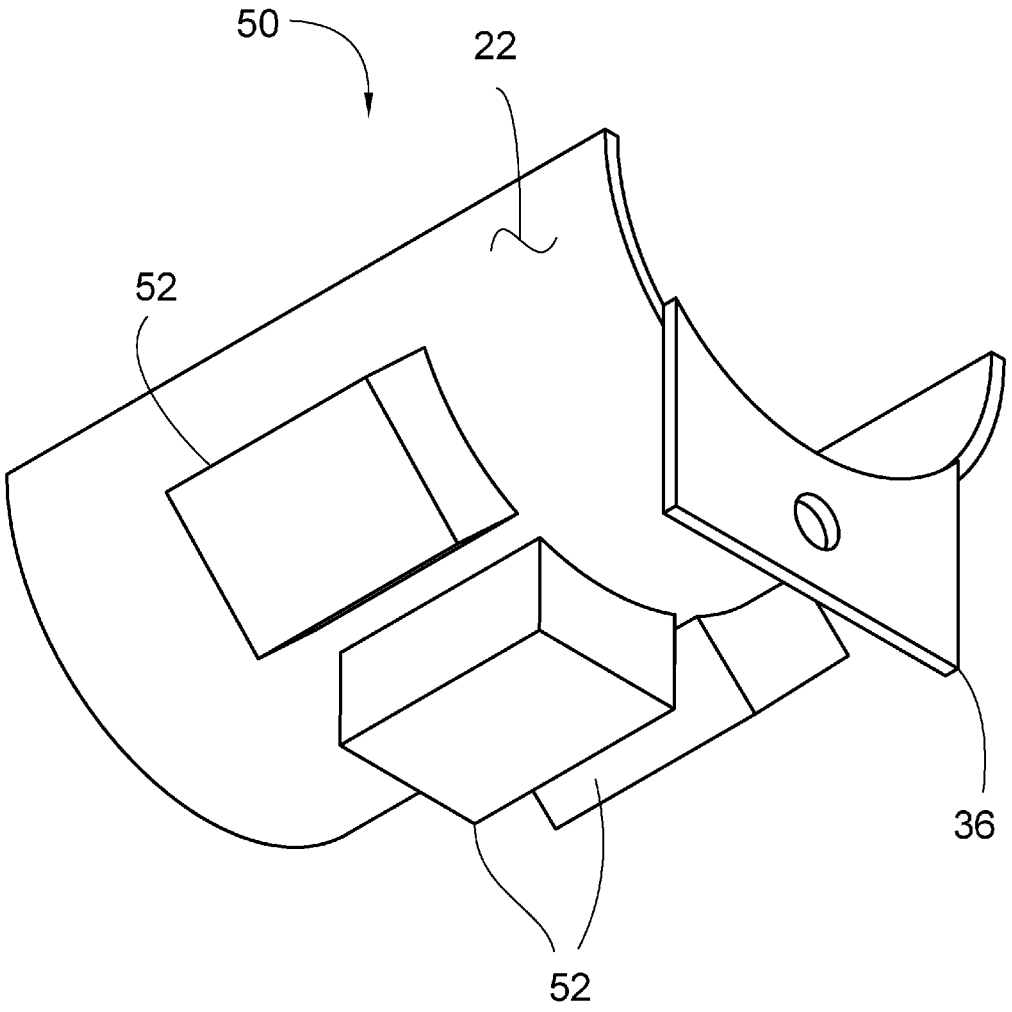
FIG. 3 is a perspective view of padded shim of an embodiment of the disclosure.
Figure 4:
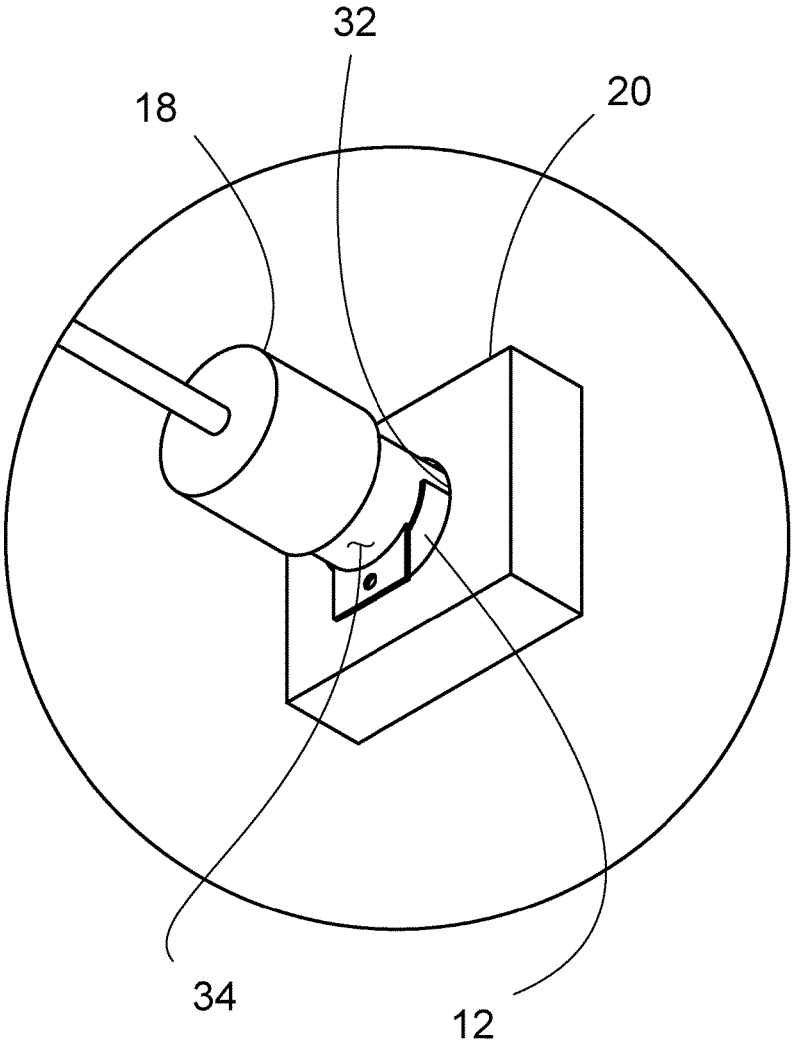
FIG. 4 is a perspective in-use view of an embodiment of the disclosure.

With reference now to the drawings, and in particular to FIGS. 1 through 4 thereof, a new shim assembly embodying the principles and concepts of an embodiment of the disclosure and generally designated by the reference numeral 10 will be described.

As best illustrated in FIGS. 1 through 4, the electrical socket shim assembly 10 generally comprises a plurality of shims 12 and each of the shims 12 has a first lateral side 14 and a second lateral side 16. Each of the shims 12 is concavely arcuate between the first lateral side 14 and the second lateral side 16. Thus, each of the shims 12 may be positioned between a corresponding circular electrical plug 18 and a corresponding circular electrical socket 20. The corresponding circular electrical socket 20 may be a trailer light socket on a semi trailer and the corresponding circular electrical plug 18 may be a trailer light plug on a semi tractor. Each of the shims 12 has a unique thickness with respect to each other for occupying a unique amount of space in between the corresponding circular electrical socket 20 and the corresponding circular electrical plug 18.

Each of the shims 12 has a first surface 22, a second surface 24 and a peripheral edge 26 extending therebetween. The peripheral edge 26 includes the first lateral side 14, the second lateral side 16, a front side 28 and a back side 30. Each of the first surface 22 and the second surface 24 is concavely arcuate between the first lateral side 14 and the second lateral side 16, and the first surface 22 and the second surface 24 are co-arcuate with respect to each other. In this way the first surface 22 conforms to a bounding surface 32 of the circular electrical socket 20 and the second surface 24 conforms an outer surface 34 of the circular electrical plug 18. Each of the shims 12 may have a length ranging between approximately 2.0 cm and 8.0 cm. Additionally, the shims 12 may have a respective thickness of approximately 1.5 mm, 3.0 mm and 6.0 mm.

A plurality of tabs 36 is included and each of the tabs 36 is coupled to a respective one of the shims 12. Each of the tabs 36 is secured to a support when the respective shim 12 is positioned between the corresponding circular electrical plug 18 in the corresponding circular electrical socket 20. In this way the respective shim 12 is inhibited from being removed from the corresponding electrical socket 20. The support may be an outer wall of the semi trailer, a housing of the corresponding circular electrical socket 20 or any other structure to which the corresponding circular electrical socket 20 is coupled.

Each of the tabs 36 has a primary surface 40, a secondary surface 42 and an outside edge 44 extending therebetween, and the outside edge 44 of each of the tabs 36 has a top side 46. The primary surface 40 of each of the tabs 36 is coupled to the front side 28 of the respective shim 12 having each of the tabs 36 extending downwardly from the respective shim 12. The top side 46 of each of the tabs 36 is concavely arcuate. Thus, the top side 46 of each of the tabs 36 conforms to the curvature of the second surface 24 of the respective shim 12. Each of the tabs 36 has an aperture 48 extending through the primary surface 40 and the secondary surface 42 for receiving a fastener that engages the support 38 to secure the tabs 36 to the support.

The plurality of shims 12 includes a padded shim 50, and a plurality of pads 52 is included. Each of the pads 52 is coupled to the first surface 22 of the padded shim 50. The pads 52 are spaced apart from each other and are distributed between the first lateral side 14 and the second lateral side 16 of the padded shim 50. Additionally, the pads 52 are positioned between the tab 36 on the padded shim 50 and the back side 30 of the padded shim 50. The pads 52 on the padded shim 50 frictionally engage the bounding surface 32 of the corresponding circular electrical socket 20.

In use, a selected one of the shims 12 is positioned in the corresponding circular electrical socket 20. The corresponding circular electrical plug 18 is inserted into the corresponding circular electrical socket 20. Moreover, the selected shim 12 is chosen such that the thickness of the selected shim 12 matches as closely as possible a gap that exists between the outer surface 34 of the corresponding circular electrical socket 20 and the corresponding circular electrical plug 18. Thus, the selected shim 12 inhibits the corresponding electrical plug 18 from moving in the corresponding electrical socket 20 and potentially causing an intermittent open circuit. In this way trailer lights, electrical trailer brakes and other electrical components on a trailer are inhibited from intermittently failing due to the intermittent open circuit. Additionally, the padded shim 50 is selected when none of the other shims 12 has a thickness that is sufficient to inhibit the corresponding circular electrical plug 18 from freely moving in the corresponding circular electrical socket 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An electrical socket shim assembly being configured to occupy empty space between an electrical plug and an electrical socket thereby inhibiting unwanted motion of the electrical plug in the electrical socket, said assembly comprising:

a plurality of shims, each of said shims having a first lateral side and a second lateral side, each of said shims being concavely arcuate between said first lateral side and said second lateral side wherein each of said shims is configured to be positioned between a corresponding circular electrical plug and a corresponding circular electrical socket, each of said shims having a unique thickness compared to the thickness of each other of said shims for occupying an amount of space in the corresponding circular electrical socket, each of said shims having a first surface, a second surface and a peripheral edge extending therebetween, said peripheral edge having said first lateral side, said second lateral side, a front side and a back side, each of said first surface and said second surface being concavely arcuate between said first lateral side and said second lateral side and being co-arcuate with respect to each other, said first surface conforming to a bounding surface of the circular electrical socket, said second surface conforming an outer surface of the circular electrical plug, said plurality of shims including a padded shim;

a plurality of tabs, each of said tabs being coupled to a respective one of said shims, each of said tabs being secured to a support when said respective shim is positioned between the corresponding circular electrical plug in the corresponding circular electrical socket to inhibit said respective shim from being removed from the corresponding electrical socket; and a plurality of pads, each of said pads being coupled to said first surface of said padded shim, said pads being spaced apart from each other and being distributed between said first lateral side and said second lateral side of said padded shim, said pads being positioned between said tab on said padded shim and said back side of said padded shim.

2. The assembly according to claim 1, wherein each of said tabs has a primary surface, a secondary surface and an outside edge extending therebetween, said outside edge of each of said tabs having a top side, said primary surface of each of said tabs being coupled to said front side of said respective shim having each of said tabs extending downwardly from said respective shim.

3. The assembly according to claim 2, wherein said top side of each of said tabs is concavely arcuate such that said top side of each of said tabs conforms to said second surface of said respective shim.

4. The assembly according to claim 2, wherein each of said tabs has an aperture extending through said primary surface and said secondary surface for receiving a fastener that engages the support to secure said tabs to the support.

5. An electrical socket shim assembly being configured to occupy empty space between an electrical plug and an electrical socket thereby inhibiting unwanted motion of the electrical plug in the electrical socket, said assembly comprising:

a plurality of shims, each of said shims having a first lateral side and a second lateral side, each of said shims being concavely arcuate between said first lateral side and said second lateral side wherein each of said shims is configured to be positioned between a corresponding circular electrical plug and a corresponding circular electrical socket, each of said shims having a unique thickness compared to the thickness of each other of said shims for occupying an amount of space in the corresponding circular electrical socket, each of said shims having a first surface, a second surface and a peripheral edge extending therebetween, said peripheral edge having said first lateral side, said second lateral side, a front side and a back side, each of said first surface and said second surface being concavely arcuate between said first lateral side and said second lateral side and being co-arcuate with respect to each other, said first surface conforming to a bounding surface of the circular electrical socket, said second surface conforming an outer surface of the circular electrical plug, said plurality of shims including a padded shim;

a plurality of tabs, each of said tabs being coupled to a respective one of said shims, each of said tabs being secured to a support when said respective shim is positioned between the corresponding circular electrical plug in the corresponding circular electrical socket to inhibit said respective shim from being removed from the corresponding electrical socket, each of said tabs having a primary surface, a secondary surface and an outside edge extending therebetween, said outside edge of each of said tabs having a top side, said primary surface of each of said tabs being coupled to said front side of said respective shim having each of said tabs extending downwardly from said respective shim, said top side of each of said tabs being concavely arcuate such that said top side of each of said tabs conforms to said second surface of said respective shim, each of said tabs having an aperture extending through said primary surface and said secondary surface for receiving a fastener that engages the support to secure said tabs to the support; and a plurality of pads, each of said pads being coupled to said first surface of said padded shim, said pads being spaced apart from each other and being distributed between said first lateral side and said second lateral side of said padded shim, said pads being positioned between said tab on said padded shim and said back side of said padded shim.

* * * * *